US006588315B2

(12) United States Patent
Jenne

(10) Patent No.: US 6,588,315 B2
(45) Date of Patent: Jul. 8, 2003

(54) RAM DEVICE

(75) Inventor: Dietmar Jenne, Strengelbach (CH)

(73) Assignee: Terra AG fuer Tiefbautechnik, Strengelbach (CH)

( * ) Notice: Subject to any disclaimer, the term of this patent is extended or adjusted under 35 U.S.C. 154(b) by 31 days.

(21) Appl. No.: 09/735,162

(22) Filed: Dec. 12, 2000

(65) Prior Publication Data

US 2001/0004020 A1 Jun. 21, 2001

(30) Foreign Application Priority Data

Dec. 15, 1999 (DE) ..... 199 60 510

(51) Int. Cl.[7] ..... F01B 31/02

(52) U.S. Cl. ..... 92/164; 138/155; 285/89; 285/92; 92/163

(58) Field of Search ..... 92/163, 164; 138/155, 138/96 T, 110; 173/206; 285/89, 92

(56) References Cited

U.S. PATENT DOCUMENTS 2,480,633 A * 8/1949 Christensen ..... 92/164
5,487,430 A 1/1996 Wentworth et al. ..... 173/91
5,603,383 A * 2/1997 Wentworth et al. ..... 173/91

FOREIGN PATENT DOCUMENTS

DE 42 21 471 1/1994
DE 196 37 697 6/1997

* cited by examiner

*Primary Examiner*—F. Daniel Lopez
(74) *Attorney, Agent, or Firm*—McCormick, Paulding & Huber LLP

(57) ABSTRACT

A ram device has a cylindrical housing (10) in which is arranged a pressure medium actuated impact piston and a control unit for controlling the pressure medium flow into the housing (10) and which housing (10) at its rearward end is provided with a pressure medium connector (16) and is closable by a closure part (12). The closure part (12) is threadable into an end portion (22) of the housing (10) provided with an internal thread by an externally threaded section (18) and has a second threaded section (20) which stands in engagement with a counter element (22) which abuts a housing surface (40) perpendicular to the housing axis.

5 Claims, 2 Drawing Sheets

Fig.1
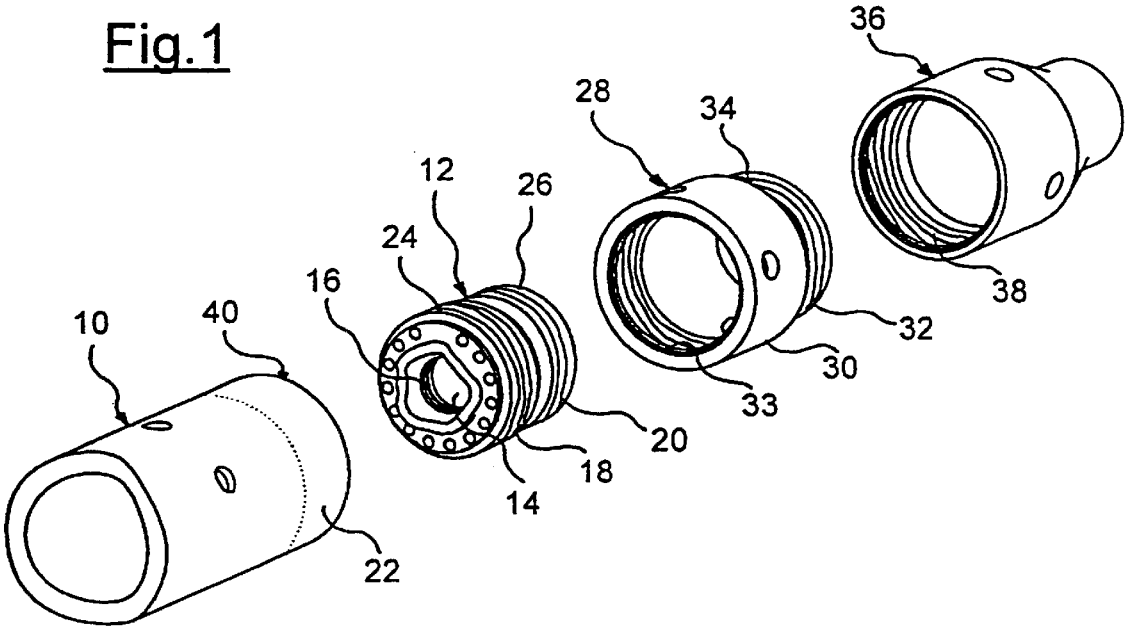
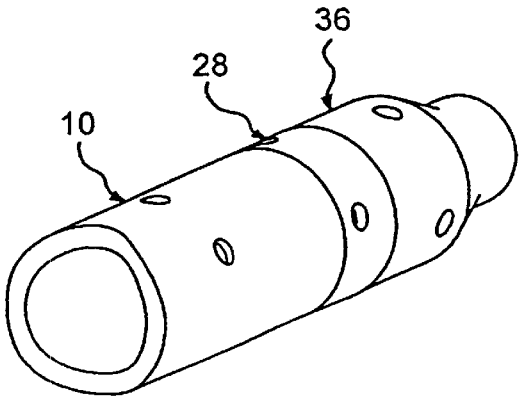
Fig.2

RAM DEVICE

FIELD OF THE INVENTION

The invention concerns a ram device with a cylindrical housing in which is arranged a pressure medium actuated impact piston and a control unit for controlling the pressure medium flow into the housing and which housing at a rearward end is provided with a pressure medium connector and is closable by a closure part which closure part is threadable into an end section of the housing provided with an internal thread by a first externally threaded section of the closure part.

BACKGROUND OF THE INVENTION

Among ram devices of the above-mentioned kind, are understood to be ram boring devices, especially pressurized air driven earth rockets, steel tube rams or pipe splitting machines. In the assembly of such ram devices, as is known, for example, from DE 196 37 697 A1, the housing is customarily connected with a workhead, for example a boring head or splitting head, with the particular kind of connection not being of closer interest here. After the insertion of the impact piston into the housing, a control unit and closure part, which are also referred to as a threaded end module, are preassembled and then together threaded into the housing.

It is known to adhesively bond the externally threaded section of the closure part to the internally threaded portion of the housing to inhibit unwanted loosening of the closure part during impacting operation. For this, a metal adhesive is used. In order for this adhesive to provide a reliable bond, the housing at its rear threaded portion must be heated after the assembly for a period of 10–20 minutes depending on the diameter of the device. This heating is accomplished by means of an electrical heating cuff. For disassembly, the device must be heated for as long as 20–60 minutes to again relax the metal adhesive.

An earth rocket is known from U.S. Pat. No. 5,487,430 in which the closure part is threaded into the housing until it comes into abutting engagement with the housing. Subsequently, an end cone is attached to the rearward end of the housing and is secured by threaded bolts which are received in threaded bores formed in the closure part. This solution makes it difficult to ensure that the control unit connected with the closure part stands in a given rotary position with respect to the impact piston as can be necessary for the control of the forward and rearward running of the ram device.

Further, with this solution, the disassembly of the closure part is bothersome because of the many bolts. The bolts during operation become bound up very tightly so that a disassembly at the construction site is often not possible and the device has to be transported to the workshop.

Further, a ram boring device with a cylindrical housing is known from DE 42 21 471 A1 in the rearward end of which an intermediate piece is threaded and into which in turn is threaded an end piece, in order to fix to the end piece a support ring for a pusher, with the support ring having an air discharge bore.

The invention has as its basic object, to so construct a ram device of the initially mentioned kind that the closure part can be reliably secured in its assembled position by simple means and can thereafter be again removed in a few minutes without the ram device for this procedure having to be transported to a workshop.

SUMMARY OF THE INVENTION

This object is solved in accordance with the invention in that the closure part has a second threaded section which stands in threaded engagement with a counter element, which counter element abuts a housing surface normal to the housing axis.

Preferably the second threaded section is likewise formed by an external thread on the outer circumference of the closure part.

The solution of the invention enables the securing of the closure part in such desired rotary position relative to the housing that the control unit also can take a desired position relative to the housing and to the impact piston. When the ram device must be unscrewed for maintenance or repair procedures, this can take place at the construction site. It is not necessary that the ram device for this be transported into a workshop.

Preferably the pitch of the winding of the first threaded section is at least twice as large as the pitch of the thread of the second threaded section. Therefore, the first thread can be a coarse trapezoidal thread and the second thread can be a fine thread, with the pitch of the trapezoidal thread, for example, being three times as large as that of the fine thread.

In an especially simple embodiment, the counter element is a counter ring provided with an internal thread. In this case, the second externally threaded section of the closure part is preferably chosen to be so long that an end cone closing the housing is threadable onto this second externally threaded section of the closure part.

In a further embodiment of the invention, the counter ring has a rearward externally threaded section onto which in turn the end cone is threadable. Here again, the thread of the externally threaded section of the counter ring is preferably a fine thread.

In the case of a ram device whose housing at its rear end has an externally threaded section onto which the closure part provided with an internally threaded section is threadable, the further threaded section can likewise be formed as an internally threaded section, into which the counter ring provided with an external thread can be threaded.

BRIEF DESCRIPTION OF THE DRAWINGS

Further features and advantages of the invention will be apparent from the following description, which in connection with the accompanying drawings explains the invention by way of exemplary embodiments. The drawings are:

FIG. 1 A schematic perspective exploded illustration of parts forming the rearward section of a ram device embodying the invention.

FIG. 2 A schematic perspective view of the part of FIG. 1 in screwed together condition.

DETAILED DESCRIPTION OF PREFERRED EMBODIMENTS

Figure 3:
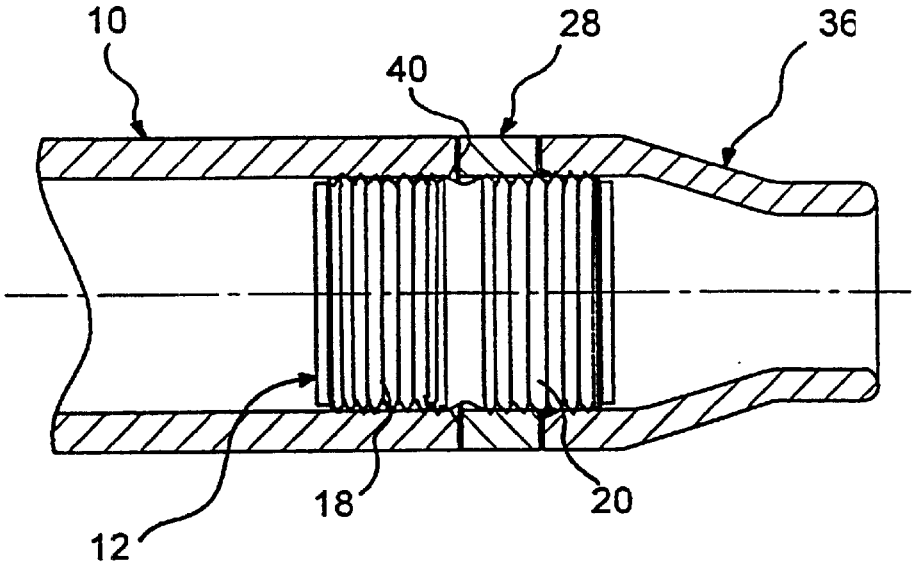
FIG. 3 A schematic section through the rearward end section of a ram device according to a further embodiment of the invention.

FIG. 1 shows only the rearward portion of the outer cylindrical housing 10 of a ram device according to the invention, in which housing a non-illustrated pressure medium actuated impact piston and an impact piston movement control unit are arranged, and which housing at its forward end can be connected with a workhead, for example, a boring head or a head suited for the splitting of pipes. The exact construction of these parts is not essential to the present invention. Therefore, these parts are not illustrated. In regard to them, reference can be made to the relevant state of the art.

The housing 10 is closed at its rearward end by a closure part indicated generally at 12, a so-called end screw, having a central bore 14 which in non-illustrated way can be connected with the control unit. A section of the central bore is provided with an internal thread 16 into which a non-illustrated pressure medium conductor can be screwed, which conductor delivers the pressure medium needed for the drive of the impact piston.

The closure part 12 has on its outer circumference a forward first threaded section 18 and a rearward second threaded section 20. With the first threaded section 18 the closure part 12 is threaded into an end portion indicated by broken lines at 22 and provided with an internal thread, of the housing 10. The external thread 24 of the threaded section 18 and the corresponding internal thread of the housing 10 is, for example, a coarse trapezoidal thread with a pitch of 6 mm. The thread 26 of the second threaded section 20 is a fine thread with a significantly lower pitch of, for example, 2 mm. The threaded section 20 serves to threadably receive a counter ring which, in the present example, has two sections 30 and 32 axially bordering one another. The forward first section 30 has an internal thread 33 corresponding to the external thread 26 of the threaded section 20, while the rear second section 32 has an external thread 34 and serves to threadably receive a conical shell 36 which, for this purpose, is provided with an internal thread 38 corresponding to the external thread 34.

The assembly of the so far described parts takes place in the following way:

After the impact piston has been inserted into the housing 10 and the control unit assembled with the closure part 12, the closure part 12 is threaded into the rearward end portion 22 of the housing 10 until the threaded section 18 has practically entirely vanished into the housing 10. Subsequently, the closure part 12 is so turned that a given marked point on the closure part 12 aligns with a bolt which is welded into the housing 10 and extends inwardly of the housing. This non-illustrated guide bolt guides the impact piston and prevents the impact piston from rotating about its longitudinal axis in the housing 10. Thereafter the counter ring 28 is screwed onto the rearward threaded section 20 of the closure part 12 until it stands at the rearward end surface 40 of the housing 10 which is normal to the axis. The pitch of the fine thread 26 should be at least half as small as the pitch of the thread 24. Then the counter ring 28 is firmly tightened using suitable work tools. In doing so, the closure part 12, to which the pressure medium conductor has already been connected, becomes firmly rotatably fixed.

By the tight drawing or the tight hammering of the counter ring, the closure part 12 is tensioned with respect to the housing, so that even with the impacts of the impact piston which appear during operation, it can no longer become independently loosened. Subsequently, the conical shell 36 is threaded onto the rearward section 32 of the counter ring 28. In the case of both the thread 34 and the thread 38, it is advantageous if the thread is a fine one.

In assembled condition, the ram device then has the form illustrated in FIG. 2, wherein the pressure medium hose is guided out of the rearward end of the conical shell 36.

FIG. 3 shows a modified embodiment of the invention in which similar parts are again provided with similar reference numbers. The counter ring 28 is in this case made as a simple ring whose axial extent takes up only a portion of the threaded section 20 of the closure part 12. Onto the remaining part of the threaded section 20 extending out of the counter ring 21 is directly threaded the conical shell 36. This solution is especially suited for ram devices with a small total diameter.

Figure 4:
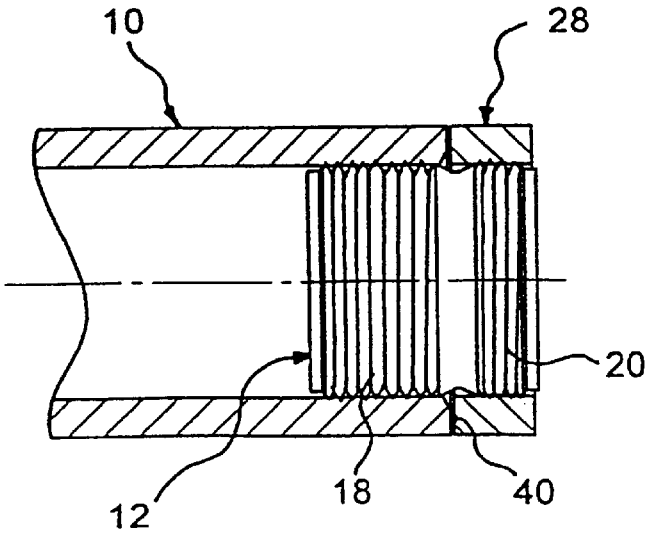
FIG. 4 A view similar to FIG. 3 through a third embodiment of the invention.

FIG. 4 finally shows a further simplified solution which in comparison to the solution of FIG. 3 omits the conical shell 36 and has the counter ring 28 form the axial closure of the ram device.

As the preceding description shows, with the counter ring of the invention, the end screw or closure part 12 is held in a pre-given rotary position relative to the housing 10 so that the closure part 12 does not change this rotary position even during operation. On the other hand, the counter ring nevertheless can be loosened with customary work tools at the construction site and can be again tightly drawn on in order carry out maintenance or repair procedures on the ram device. Transport of the ram device to a workshop is not necessary.

What is claimed is:

1. A pressure medium actuated ram device comprising:

a cylindrical housing (10) closed at a rearward end portion (22) by a closure part (12) which closure part is provided with a first externally threaded section (18) which is threaded into the rearward end portion of the cylindrical housing (10), the rearward end portion (22) of the cylindrical housing (10) having an internal thread threadably cooperable with the first externally threaded section (18) of the closure part (12), and a counter element (28) having a counter ring provided with an internal thread (33), the counter ring having a rearward externally threaded section (34) onto which a conical end shell (36) is threadably receivable, the closure part having a second threaded section (20) which stands in threaded engagement with the counter element (28), the rearward end portion (22) of the housing having a rearwardly facing annular surface (40) and the counter element (28) having a forwardly facing annular surface so that in an assembly of the cylindrical housing, the closure part and the counter element with one another, the closure part is in threaded connection with the cylindrical housing at a desired position selected from many possible positions relative to the housing, and the counter element is in threaded engagement with the closure member engaging said rearwardly facing and forwardly facing annular surfaces fixing the closure element in the desired position relative to the cylindrical housing.

2. A ram device according to claim 1, wherein the thread (34) of the externally threaded section (32) of the counter ring (28) is a fine thread.

3. A pressure medium actuated ram device comprising:

a cylindrical housing (10) closed at a rearward end portion (22) by a closure part (12) which closure part is provided with a first externally threaded section (18) which is threaded into the rearward end portion of the cylindrical housing (10), the rearward end portion (22) of the cylindrical housing (10) having an internal thread threadably cooperable with the first externally threaded section (18) of the closure part (12), the first externally threaded section having a thread (24) with a pitch, and a counter element (28), the closure part having a second threaded section (20) which stands in threaded engagement with the counter element (28), the second threaded section having a fine thread (26) with a pitch, the pitch of the thread (24) of the first threaded section (18) being at least twice as large as the pitch of the fine thread of the second threaded section (20), the rearward end portion (22) of the housing having a rearwardly facing annular surface (40) and the counter element (28) having a forwardly facing annular surface so that in an assembly of the cylindrical housing, the closure part and the counter element with one another, the closure part is in threaded connection with the cylindrical housing at a desired position selected from many possible positions relative to the housing, and the counter element is in threaded engagement with the closure member engaging said rearwardly facing and forwardly facing annular surfaces fixing the closure element in the desired position relative to the cylindrical housing.

4. A ram device according to claim 3, wherein the pitch of the thread (24) of the first threaded section (18) is about three times as large as the pitch of the thread (26) of the second threaded section (20).

5. A pressure medium actuated ram device comprising:

a cylindrical housing (10) closed at a rearward end portion (22) by a closure part (12) which closure part is provided with a first externally threaded section (18) which is threaded into the rearward end portion of the cylindrical housing (10), the rearward end portion (22) of the cylindrical housing (10) having an internal thread threadably cooperable with the first externally threaded section (18) of the closure part (12), and a counter element (28) having a counter ring provided with an internal thread, the closure part having a second threaded section (20) which stands in threaded engagement with the counter element (28) wherein on a portion of the second threaded section (20) of the closure part (12) which axially overlaps the counter ring (28) is threadably received a conical end shell (36), the rearward end portion (22) of the housing having a rearwardly facing annular surface (40) and the counter element (28) having a forwardly facing annular surface so that in an assembly of the cylindrical housing, the closure part and the counter element with one another, the closure part is in threaded connection with the cylindrical housing at a desired position selected from many possible positions relative to the housing, and the counter element is in threaded engagement with the closure member engaging said rearwardly facing and forwardly facing annular surfaces fixing the closure element in the desired position relative to the cylindrical housing.

* * * * *